US008047544B2

(12) United States Patent
Sekino

(10) Patent No.: US 8,047,544 B2
(45) Date of Patent: Nov. 1, 2011

(54) PRINTING APPARATUS

(75) Inventor: Toshiharu Sekino, Shizuoka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 49 days.

(21) Appl. No.: 12/553,192

(22) Filed: Sep. 3, 2009

(65) Prior Publication Data

US 2010/0059922 A1 Mar. 11, 2010

(30) Foreign Application Priority Data

Sep. 9, 2008 (JP) ..... 2008-231288

(51) Int. Cl.
*B65H 29/00* (2006.01)
*B65H 39/10* (2006.01)

(52) U.S. Cl. ..... 271/303; 271/902; 271/186; 271/245; 271/246; 271/304

(58) Field of Classification Search ..... 271/245, 271/246, 902, 186, 303, 304
See application file for complete search history.

(56) References Cited

U.S. PATENT DOCUMENTS 4,320,854 A * 3/1982 Hirose ..... 221/12
4,747,493 A * 5/1988 Nakanishi ..... 209/534
4,750,853 A * 6/1988 Van Soest et al. ..... 414/789.9
4,822,018 A * 4/1989 Hain ..... 271/3.2
5,082,272 A * 1/1992 Xydias et al. ..... 271/186
5,106,077 A * 4/1992 Kawaguchi et al. ..... 271/302
5,330,316 A * 7/1994 Buckman et al. ..... 414/790.2
5,356,263 A * 10/1994 Miller ..... 414/790.7
5,435,542 A * 7/1995 Van Pham et al. ..... 271/246
5,449,164 A * 9/1995 Quesnel et al. ..... 271/186
5,551,681 A * 9/1996 Ferrara ..... 270/58.08
5,735,516 A * 4/1998 Gerlier et al. ..... 270/60
6,199,858 B1 * 3/2001 Wyer ..... 271/186
6,454,255 B1 * 9/2002 Allen et al. ..... 271/176
6,679,682 B2 * 1/2004 Lee ..... 415/206
7,613,422 B2 * 11/2009 Shida et al. ..... 399/407
7,726,648 B2 * 6/2010 Tamura et al. ..... 271/176
2010/0078869 A1 4/2010 Sanada et al.

FOREIGN PATENT DOCUMENTS

JP 10250914 9/1998
JP 2007-156406 6/2007

* cited by examiner

*Primary Examiner* — Stefanos Karmis
*Assistant Examiner* — Luis A Gonzalez
(74) *Attorney, Agent, or Firm* — Turocy & Watson, LLP

(57) ABSTRACT

A printing apparatus includes a holding section connected to a downstream end of a main transfer path for consecutively transferring paper sheets and formed of a curved transfer path, which consecutively transfers the paper sheets led out from the main transfer path in a curved state and holds them in an overlaid state.

8 Claims, 12 Drawing Sheets

PRINTING APPARATUS

CROSS-REFERENCE TO RELATED APPLICATION

This application is based upon and claims the benefit of priority from prior Japanese Patent Application No. 2008-231288, filed Sep. 9, 2008, the entire contents of which are incorporated herein by reference.

TECHNICAL FIELD

The present invention relates to a printing apparatus mounted in an automatic teller machine, and particularly to a structure of a holding section which temporarily holds a plurality of printed paper sheets in an overlaid state.

BACKGROUND

A printing apparatus of this type transfers a paper sheet along a transfer path and prints financial transaction information on the paper sheet by a printing section. It ejects the printed paper sheet to an ejecting section to have the customer receive it.

The printing apparatus in the automatic teller machine may successively print a plurality of paper sheets. In this case, the printed paper sheets are temporarily held in an overlaid state in a holding section and then ejected, so that the customer can easily receive them. The held paper sheets are taken from the holding section and discharged to the discharge section (for example, see Jpn. Pat. Appln. KOKAI Publication No. 2007-156406).

Conventionally, however, the printed paper sheets are fallen under their own weight and held in the holding section in a vertical state. Therefore, the holding section requires a space in the vertical direction of at least the length of the paper sheets. Accordingly, there is a problem that that the size of the printing apparatus is inevitably large in height.

SUMMARY

The present invention in one aspect has been made in consideration of the above drawback of the conventional art. An object of the present invention is to provide a printing apparatus, which can hold a plurality of paper sheets without a need of large space in the vertical direction.

According to an aspect of the present invention, there is provided a printing apparatus comprising: a transfer device which continuously transfer paper sheets along a main transfer path; a printing device which prints information on the paper sheets, which are consecutively transferred along the main transfer path; a holding section connected to a downstream end of the main transfer path and formed of a curved transfer path, which consecutively transfers the paper sheets led out from the main transfer path in a curved state and holds them in an overlaid state; a sending device, which collectively sends the paper sheets out of the holding section; and an ejecting section, which ejects the paper sheets collectively sent out by the sending device.

According to the aspect of the present invention, a plurality of paper sheets can be held without a need of large space in the vertical direction. As a result, the height of the apparatus can be reduced.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

DESCRIPTION OF THE DRAWINGS

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION

An embodiment of the present invention will be described below in detail with reference to the accompanying drawings.

Figure 1:
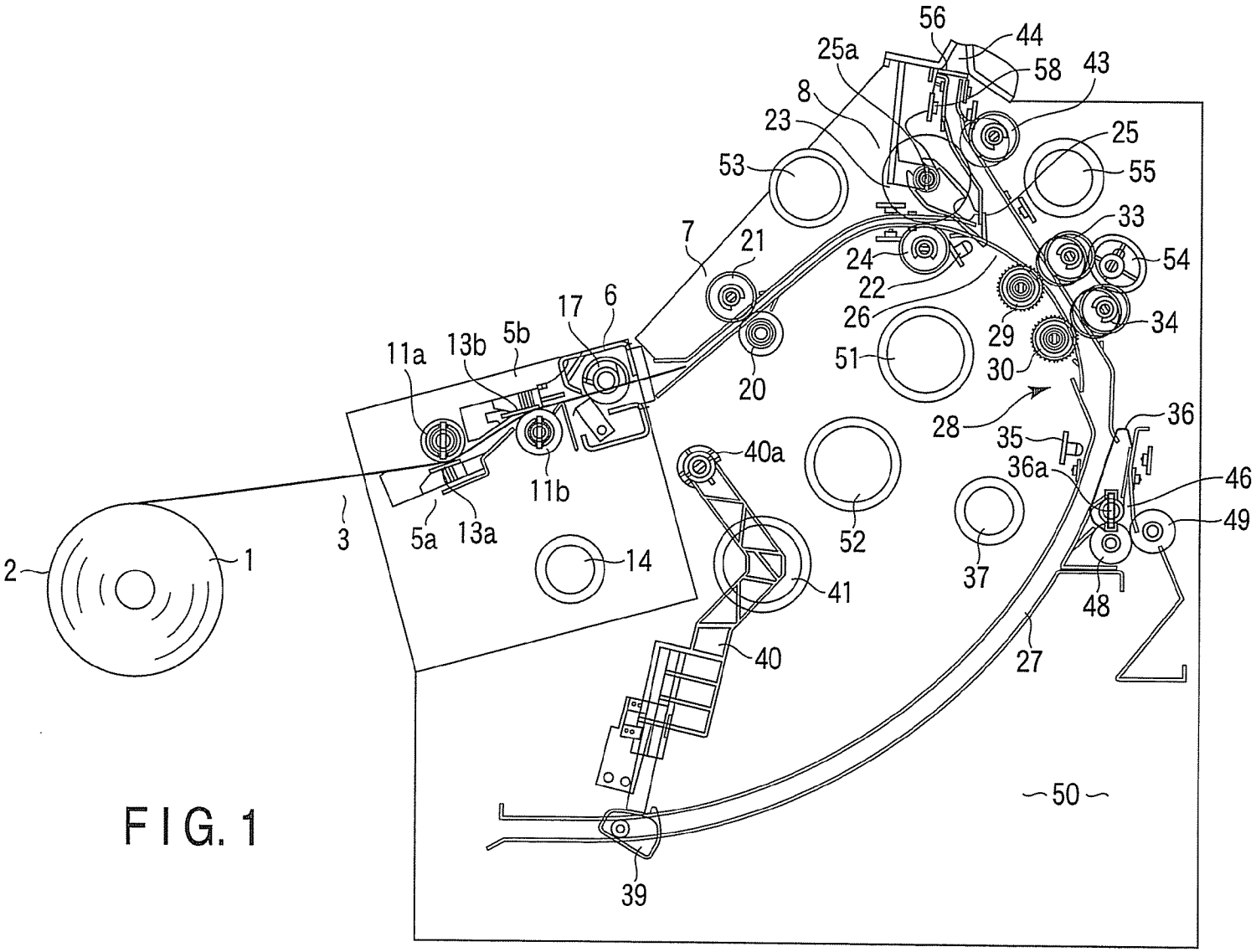
FIG. 1 is a configuration diagram schematically showing a printing apparatus according to an embodiment of the present invention.

FIG. 1 is a configuration diagram schematically showing a printing apparatus mounted in an automatic teller machine according to an embodiment of the present invention.

Referring to the drawings, a roll paper 1 is loaded in a roll paper loading section 2. A leading end of the roll paper 1 is led out from the roll paper loading section 2 and transferred along a main transfer path 3. Paper is not limited to the roll paper, but may be a fanfold paper. A downstream end of the main transfer path 3 is connected to a curved transfer path 28, which transfers paper in a curved state and serves as a holding section. The curved transfer path 28 is formed of a first arc-shaped transfer path 26 connected to the downstream end of the main transfer path 3, and a second arc-shaped transfer path 27 connected to a downstream end of the first arc-shaped transfer path 26.

In the main transfer path 3, first and second printing sections 5*a* and 5*b*, a cutter section 6, a first transfer roller section 7 and a second transfer roller section 8 are arranged in this order along the direction of transfer of the paper sheet.

The first and second printing sections 5*a* and 5*b* respectively comprises platens 11*a* and 11*b* and thermal heads 13*a* and 13*b*. The platens 11*a* and 11*b* respectively face the thermal heads 13*a* and 13*b* via the main transfer path 3. The thermal heads 13*a* and 13*b* are elastically forced toward the platens 11*a* and 11*b* by head springs (not shown). The platens 11*a* and 11*b* are rotationally driven by a platen driving motor 14. The cutter section 6 has a cutter 17 and a cutter driving motor (not shown) which drives the cutter 17.

The first transfer roller section 7 holds and transfers the roll paper 1. It comprises a first driving roller 20 and a first pinch roller 21, which face each other via the main transfer path 3. The first pinch roller 21 is elastically forced toward the first driving roller 20 by a roller spring.

The second transfer roller section 8 also holds and transfers the roll paper 1. It comprises a second driving roller 23 and a second pinch roller 24, which face each other via the main transfer path 3. The second pinch roller 24 is elastically forced toward the second driving roller 23 by a roller spring. The first and second driving rollers 20 and 23 are rotationally driven by a first driving motor 51.

A flapper 25, which is forced by its own weight or a weak spring, is provided downstream from the second driving roller 23. The flapper 25 is rotatably supported at one end thereof by a support shaft 25*a*, and rotated up and down about the support shaft 25*a* to open and close the transfer path.

The aforementioned first arc-shaped transfer path 26 is located downstream from the flapper 25. A third driving roller 29 and a fourth driving roller 30 are arranged in the first arc-shaped transfer path 26. The third driving roller 29 and the fourth driving roller 30 are rotationally driven forward and backward by a second driving motor 52.

The third driving roller 29 and the fourth driving roller 30 respectively face third and fourth pinch rollers 33 and 34. The third and fourth pinch rollers 33 and 34 are pulled up by pulling springs (not shown) and spaced apart from the third and fourth driving rollers 29 and 30.

A cam 54 is located near the third and fourth pinch rollers 33 and 34. The third and fourth pinch rollers 33 and 34 are pushed down by rotation of the cam 54 against the force of the pulling springs, and brought into contact with the third and fourth driving rollers 29 and 30. The cam 54 is rotated by a cam driving motor 55. In accordance with the amount of rotation of the cam 54, the third and fourth pinch rollers 33 and 34 are forced against the third and fourth driving rollers 29 and 30 by weak or strong force, so that the paper sheet is held and transferred.

First and second detecting sensors 22 and 35, which detect the leading end of a transferred paper sheet, are arranged near the above-described flapper 25 and a flapper 36 described later. The cam 54 is rotated on the basis of the detection of the first detecting sensor 22 or the second detecting sensor 35.

Figure 3:
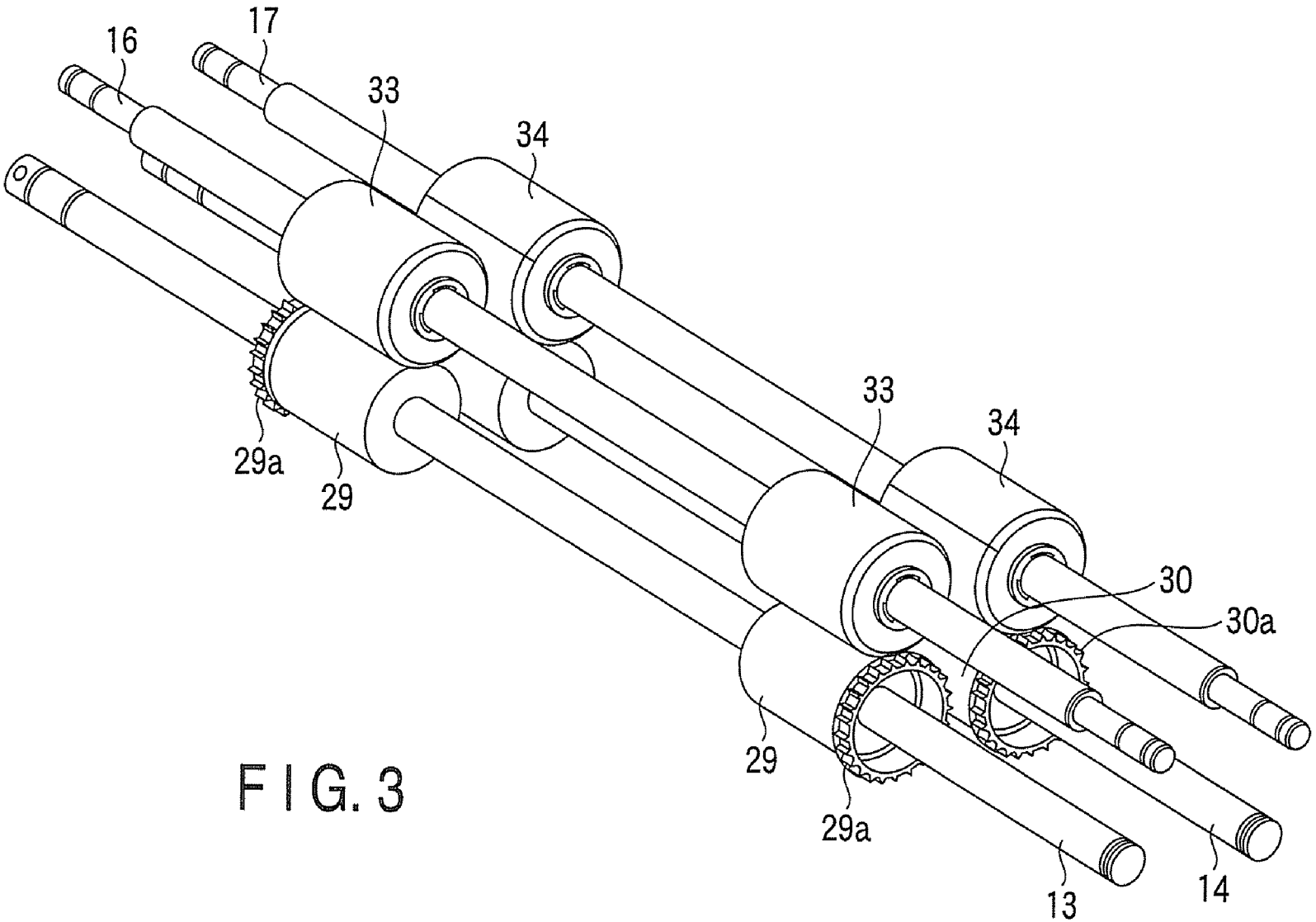
FIG. 3 is a diagram showing a perspective view of third and fourth driving rollers and third and fourth pinch rollers.

As shown in FIG. 3, the third driving roller 29 and the fourth driving roller 30 respectively have a rugged portion 29*a* and a rugged portion 30*a*, at one end of their periphery. Each of the rugged portions has continuous teeth along the circumferential direction. Because of the rugged portions 29*a* and 30*a*, stable transfer force can be exerted on the paper sheet, even when the third and fourth pinch rollers 33 and 34 are brought into contact with the third and fourth driving rollers 29 and 30 by weak force.

The flapper 36 is located downstream from the fourth driving roller 30. The flapper 36 is rotatably supported at a lower end thereof by a support shaft 36*a*. The flapper 36 is rotated left and right by a flapper driving motor 37. As a result, the transfer route is switched to the second arc-shaped transfer path 27 or a collecting transfer path 46.

Figure 2:
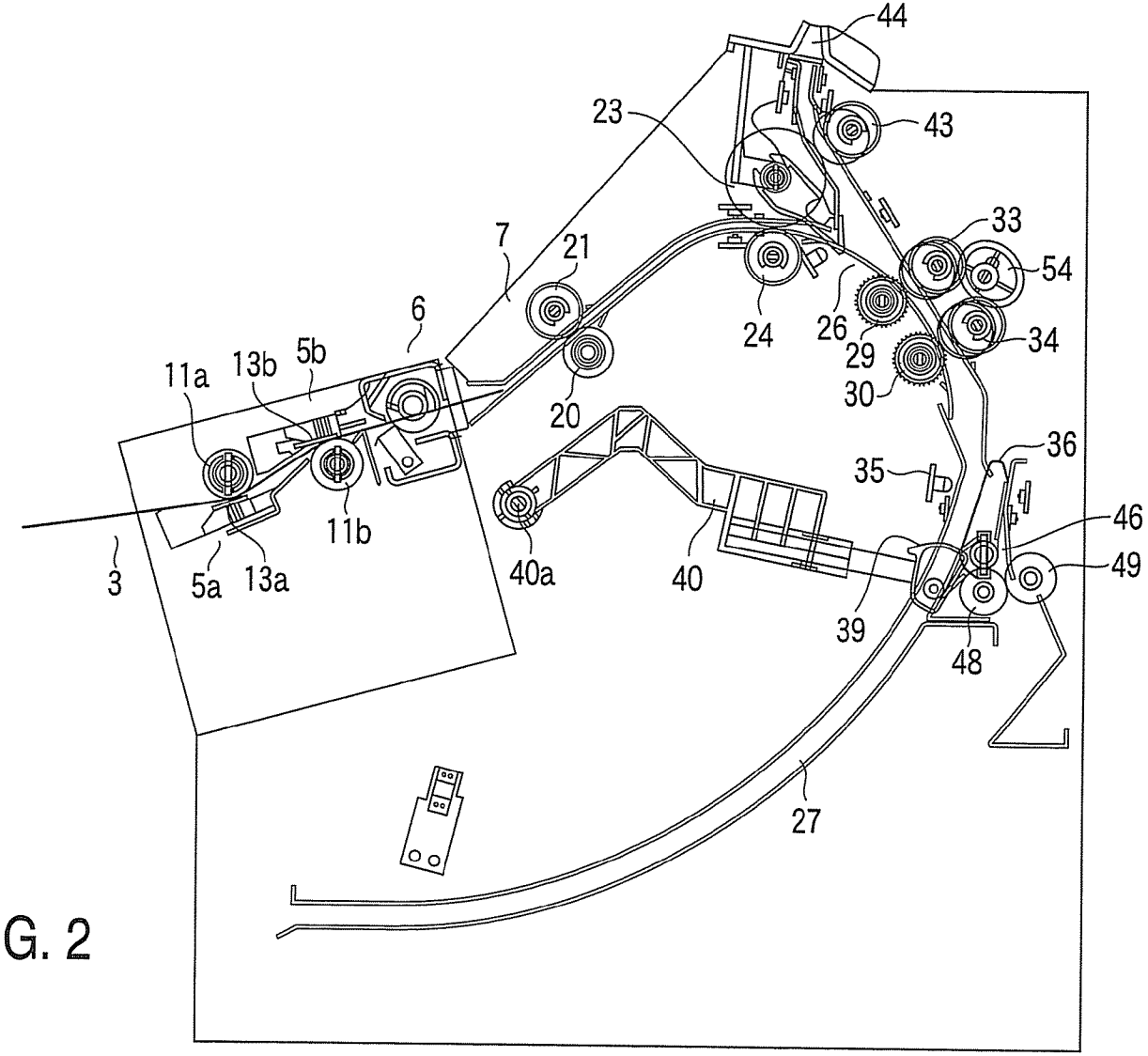
FIG. 2 is a diagram showing a state in which a stopper shown in FIG. 1 is moved to an upstream side of a second arc-shaped transfer path.

The second arc-shaped transfer path 27 is located downward from the flapper 36. It includes a stopper 39, to which the leading end of a transferred paper sheet is brought into contact to stop the paper sheet. The stopper 39 is supported by a lower end of a stopper arm 40. The stopper arm 40 is rotated forward or backward by a stopper driving motor 41 according to the length of the paper sheet. By the rotation of the stopper arm 40, the stopper 39 moves along the second arc-shaped transfer path 27. If the paper sheet is relatively long, the stopper 39 moves to a downstream side of the second arc-shaped transfer path 27, as shown in FIG. 1, to stop the paper sheet. If the paper sheet is relatively short, the stopper 39 moves to an upstream side of the second arc-shaped transfer path 27, as shown in FIG. 2, to stop the paper sheet.

The axis of rotation 40*a* of the stopper arm 40 is located between the center of radius of the second arc-shaped transfer path 27 and the second arc-shaped transfer path 27. As a result, the radius of the second arc-shaped transfer path 27 is large enough to minimize the curve of the paper sheet, so that the transfer paper jam can be avoided. In this case, since the center of rotation of the stopper arm 40 does not coincide with the center of radius the second arc-shaped transfer path 27, the stopper 39 and the stopper arm 40 are configured to slide to change the position of the stopper 39.

A fifth pinch roller 43 is located obliquely above the second driving roller 23 in the main transfer path 3. The fifth pinch roller 43 is brought into contact with and removed from the second driving roller 23 by a third driving motor 53. An ejecting port (ejecting section) 44 is provided above the second driving roller 23 and the fifth pinch roller 43. The ejecting port 44 is opened and closed by a shutter 56. The shutter 56 is operated by the third driving motor 53. An ejection detecting sensor 58 to detect a paper sheet to be ejected is provided under the shutter 56.

The collecting transfer path 46 switched by the second flapper 36 includes a collecting driving roller 48, and a pinch roller 49 which is forced by a spring against the collecting driving roller 48. A collecting storage 50 is arranged under the collecting driving roller 48 and the pinch roller 49. The collecting driving roller 48 is driven by the second driving motor 52.

Figure 4:
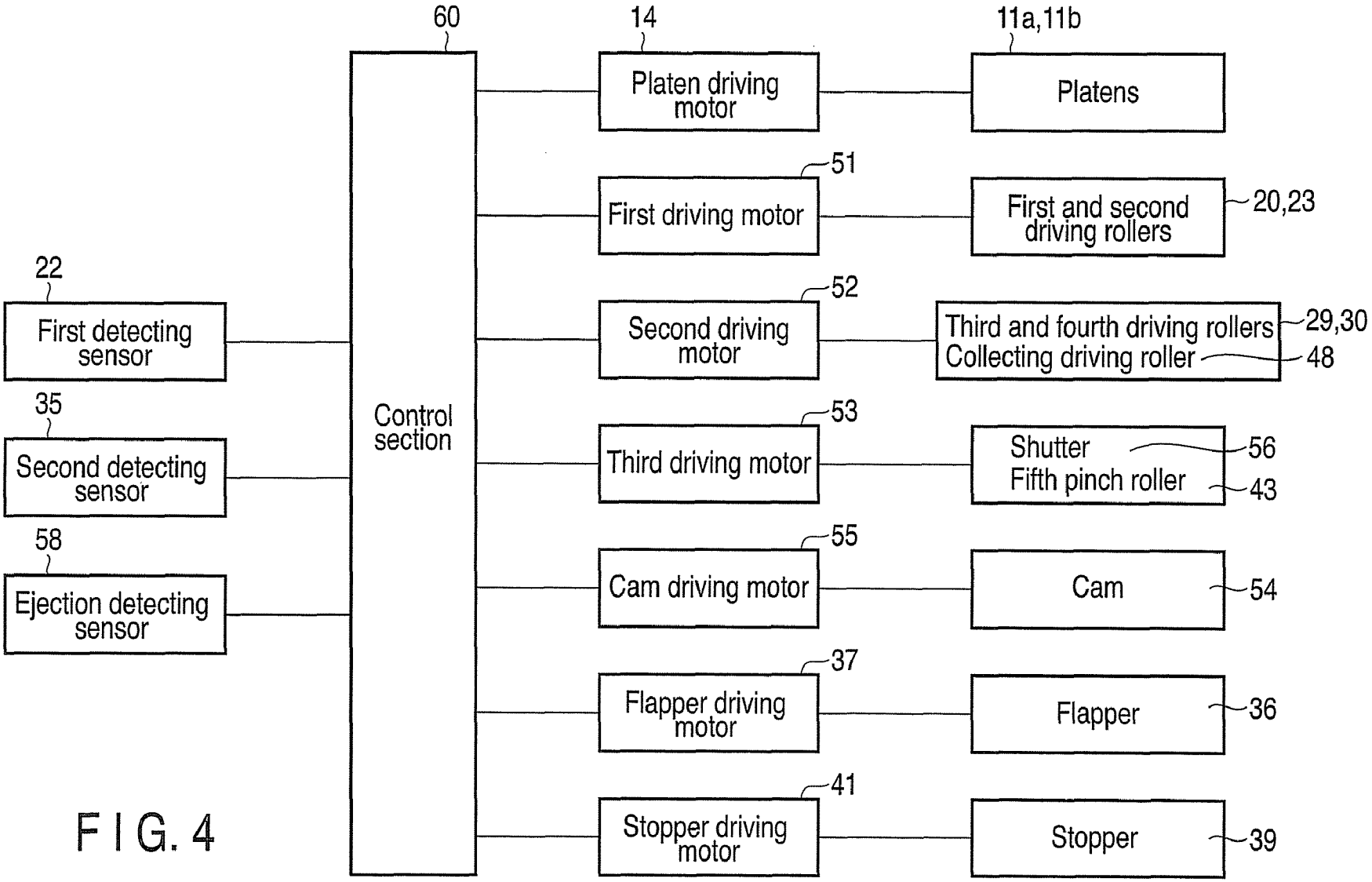
FIG. 4 is a block diagram showing a drive control system of the printing apparatus shown in FIG. 1.

FIG. 4 is a block diagram showing a drive control system of the printing apparatus described above.

The first and second detecting sensors 22 and 35 and the ejection detecting sensor 58 are connected to a control section 60 as control means via a detection signal circuit. The control section 60 is connected to the platen driving motor 14, the first to third driving motors 51 to 53, the cam driving motor 55, the flapper driving motor 37 and the stopper driving motor 41 via a control circuit.

The control section 60 controls driving of the platens 11*a* and 11*b*, the first to fourth driving rollers 20, 23, 29 and 30, the collecting driving roller 48, the shutter 56, the pinch roller 43, the cam 54, the flapper 36 and the stopper 39.

An operation of the printing apparatus will be described with reference to FIGS. 5 to 12.

Figure 5:
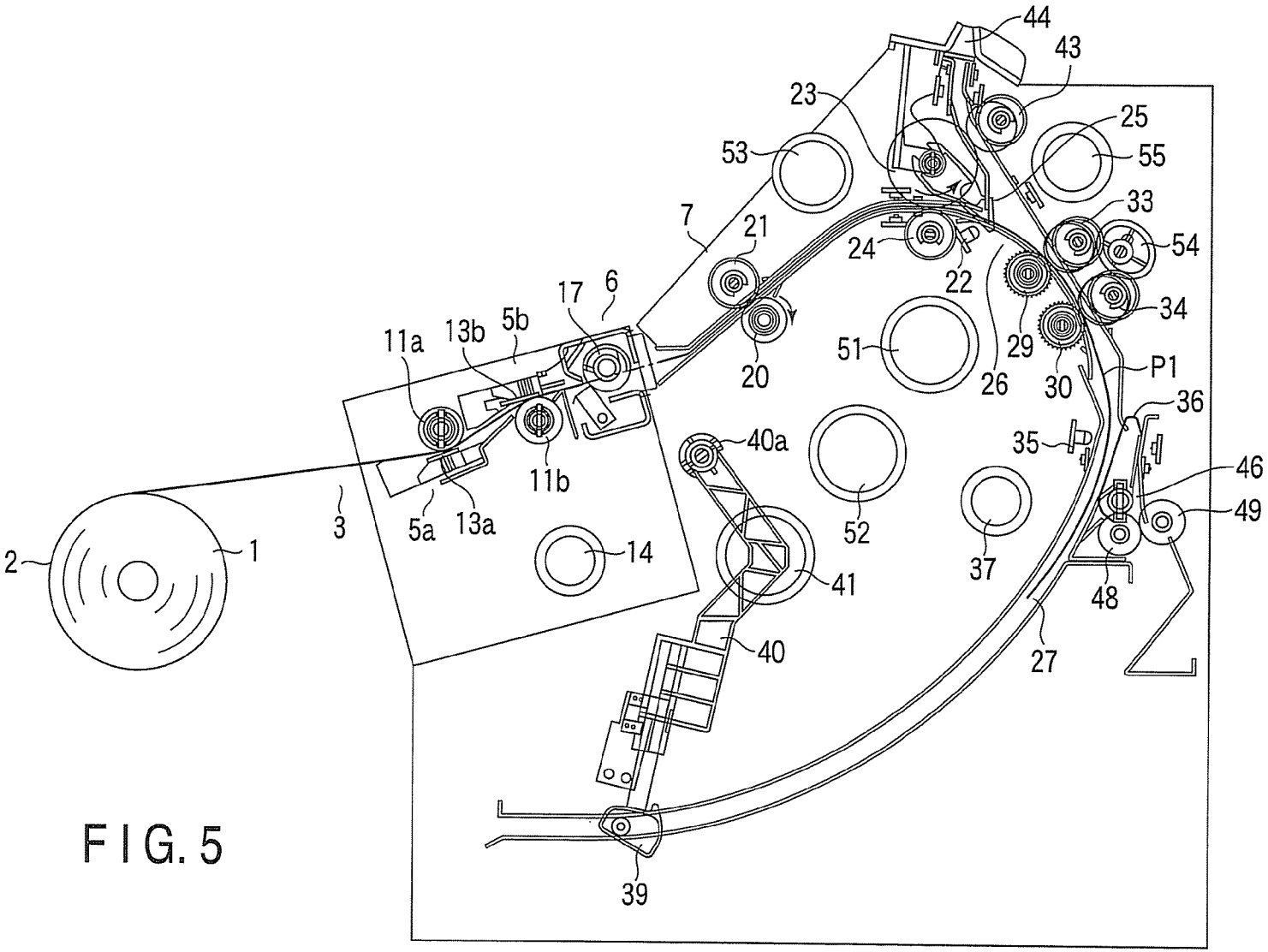
FIG. 5 is a diagram showing a state in which printed roll paper shown in FIG. 1 is sent from a main transfer path to first and second arc-shaped transfer paths and cut.
Figure 6:
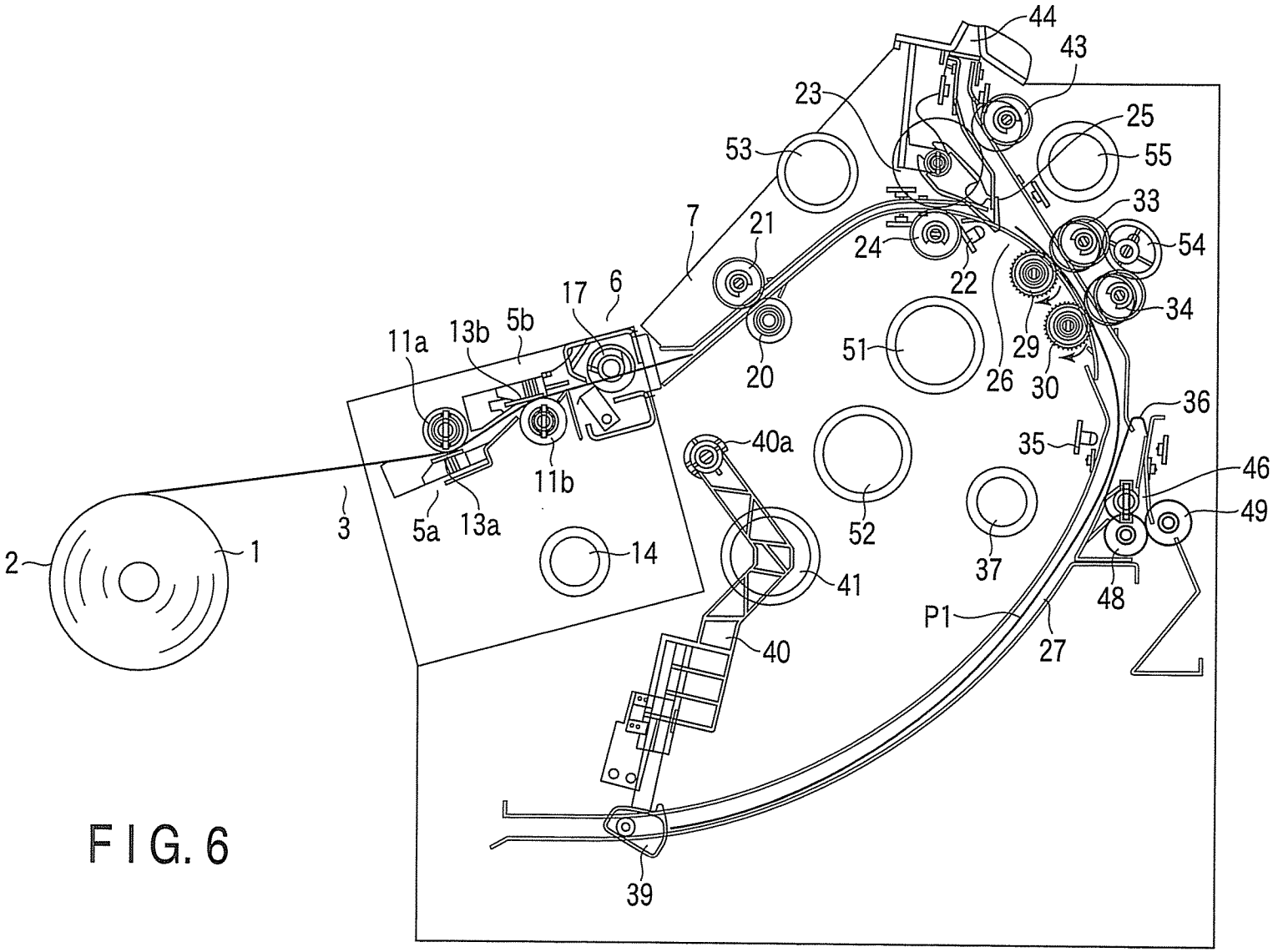
FIG. 6 is a diagram showing a state in which the cut paper sheet shown in FIG. 5 is transferred and a leading end thereof is brought into contact with the stopper and held in the first and second arc-shaped transfer paths.

First, the leading end of the roll paper 1 is held by the platens 11*a* and 11*b* and the thermal heads 13*a* and 13*b*. In this state, the platen driving motor 14 is driven. Through this drive, the roll paper 1 is held and transferred by the platens 11*a* and 11*b* and the thermal heads 13*a* and 13*b*, and transaction information is printed on both surfaces of the roll paper 1 by heat at the thermal heads 13*a* and 13*b*. The printed roll paper 1 is held and transferred by the first driving roller 20 and the first pinch roller 21, as shown in FIG. 5, and then held and transferred by the second driving roller 23 and the second pinch roller 24. The transferred roll paper 1 pushes the flapper 25 up at the leading end and passes therethrough. Then, it passes the gap between the third driving roller 29 and the third pinch roller 33 and the gap between the fourth driving roller 30 and the fourth pinch roller 34. In this time, the third and fourth pinch rollers 33 and 34 are spaced apart from the third and fourth driving rollers 29 and 30. When the leading end of the roll paper 1 is detected by the second detecting sensor 35, the cam driving motor 55 is operated to operate the cam 54. As a result, the third and fourth pinch rollers 33 and 34 are brought into contact with the third and fourth driving rollers 29 and 30 via the roll paper 1 with weak pitching force, and hold and transfer the roll paper 1. When the roll paper 1 is transferred by a predetermined distance, the cutter 17 is operated to cut the roll paper 1 to a paper sheet P1. In this time, the stopper driving motor 41 is operated to move the stopper 39 along the second arc-shaped transfer path 27 via the stopper arm 40 in accordance with the length of the paper sheet P1. The transferred paper sheet P1 is brought into contact with the stopper 39 at its leading end and stopped, as shown in FIG. 6. In this time, the rear end of the paper sheet P1 is located downstream from the flapper 25.

Figure 7:
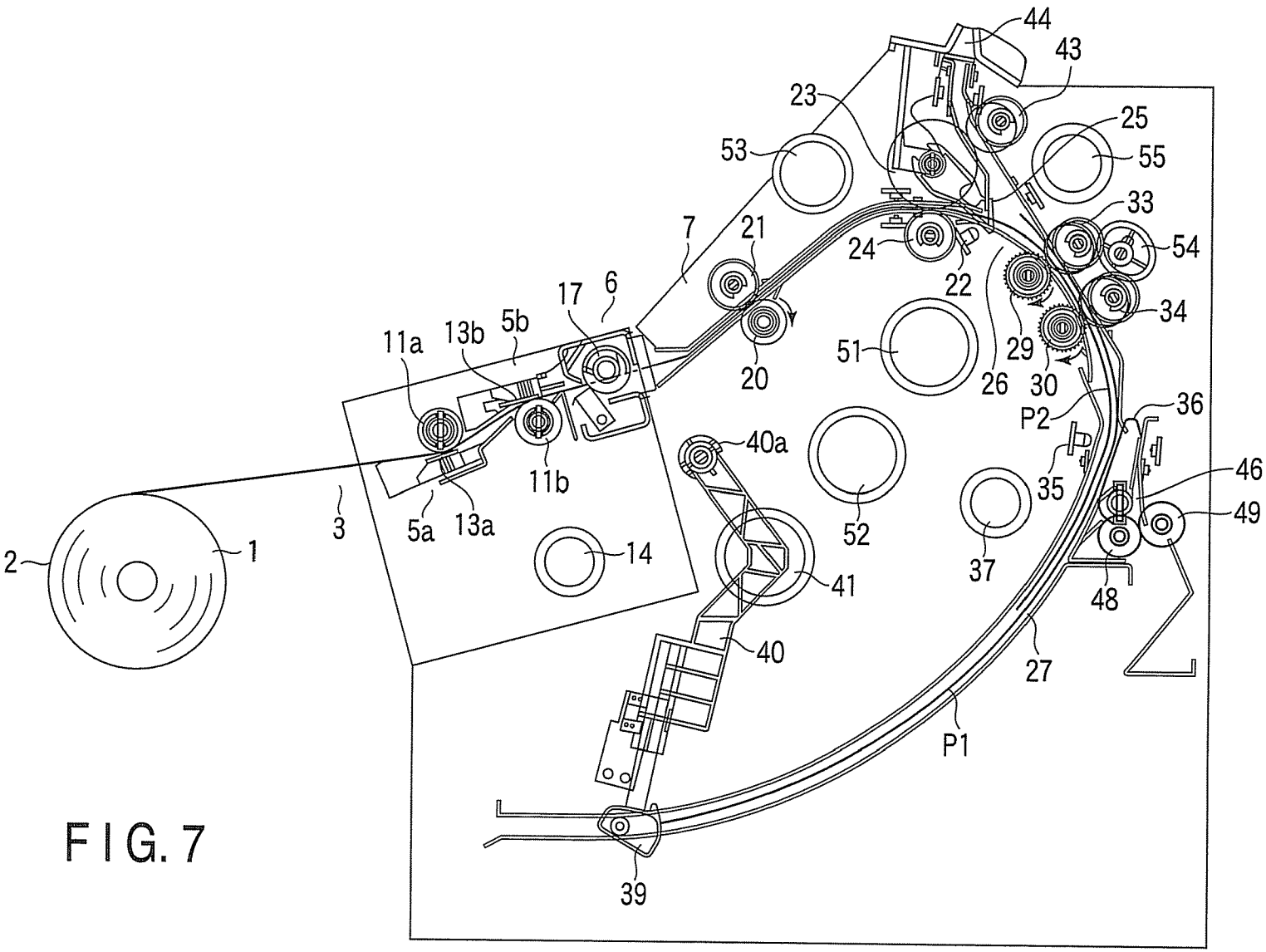
FIG. 7 is a diagram showing a state in which roll paper following the printed paper sheet held as shown in FIG. 6 is sent to the first and second arc-shaped transfer paths and cut therein.

After the first paper sheet P1 is stopped, the roll paper 1 is held and transferred by the platens 11*a* and 11*b* and the thermal heads 13*a* and 13*b*, and then transaction information is printed on both surfaces of the roll paper 1 by heat at the thermal heads 13*a* and 13*b*, in the same manner as described before. The printed roll paper 1 is held and transferred by the first driving roller 20 and the first pinch roller 21, and then held and transferred by the second driving roller 23 and the second pinch roller 24. As a result of this transfer, as shown in FIG. 7, the roll paper 1 pushes the flapper 25 up at the leading end and passes therethrough. Then, the roll paper 1 is transferred through the gap between the preceding paper sheet P1 and the third and fourth driving rollers 29 and 30. In this time, the third and fourth pinch rollers 33 and 34 are spaced apart from the third and fourth driving rollers 29 and 30 by the pulling force of the pulling springs. When the leading end of the roll paper 1 is detected by the second detecting sensor 22, the cam driving motor 55 is operated to operate the cam 54 based on the detection. The third and fourth pinch rollers 33 and 34 are brought into contact with the third and fourth driving rollers 29 and 30 via the succeeding roll paper 1 by weak pinching force, and the transfer of the roll paper 1 is continued. When the roll paper 1 is transferred by a predetermined distance, the cutter 17 is operated to cut the roll paper 1 to a paper sheet P2 having the same length as the preceding paper sheet P1.

Figure 8:
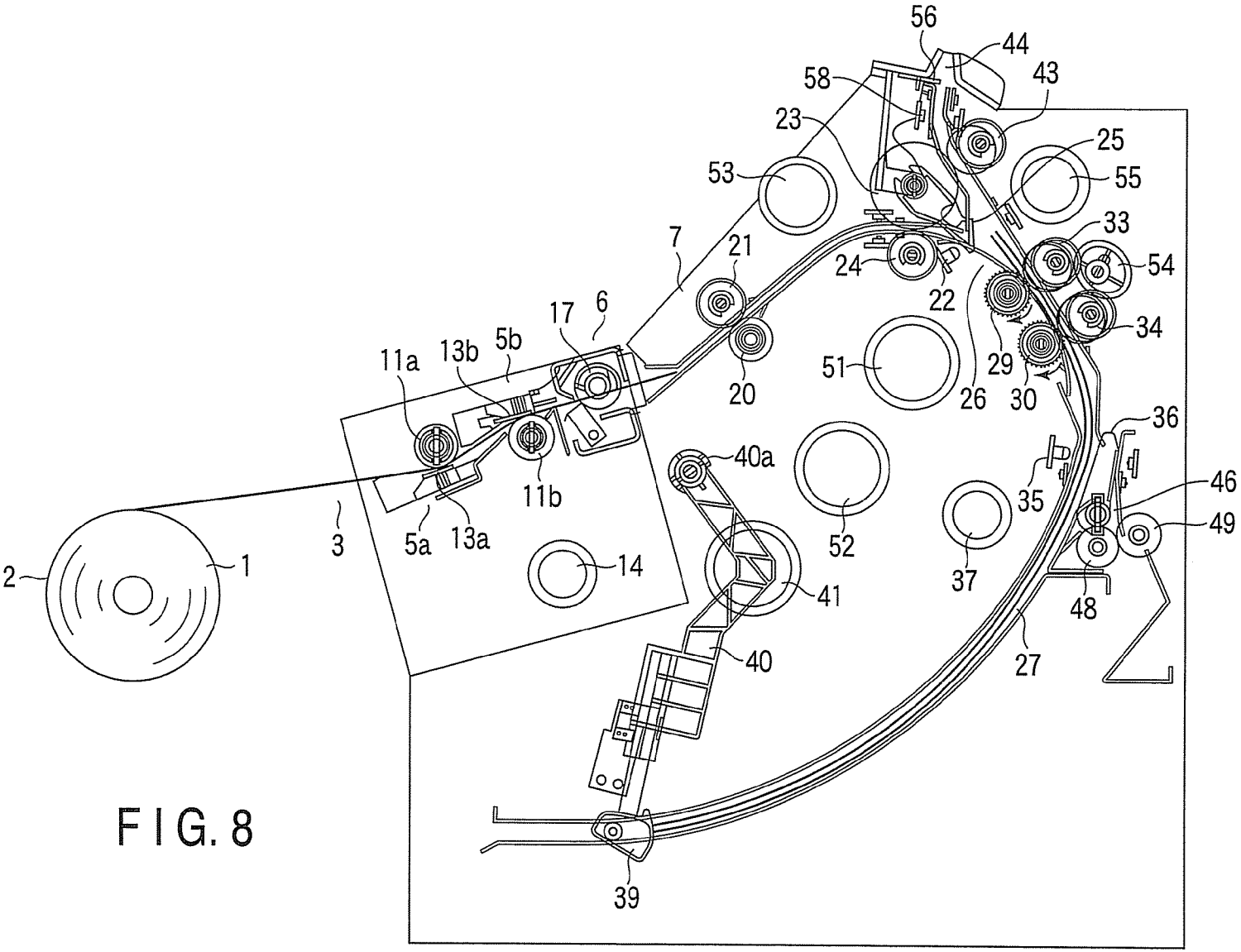
FIG. 8 is a diagram showing a state in which the cut paper sheet shown in FIG. 7 is transferred and a leading end thereof is brought into contact with the stopper and held in the first and second arc-shaped transfer paths.

When the paper sheet P2 is transferred, the stopper 39 is kept stopped. Therefore, as shown in FIG. 8, the leading end of the paper sheet P2 is brought into contact with the stopper 39 and stopped. As a result, the rear ends of the preceding paper sheet P1 and the succeeding paper sheet P2 are aligned. If third and subsequent paper sheets are transferred, the printing and transfer are repeated similarly, and a predetermined number of paper sheets are printed and stocked.

A process of ejecting the stocked paper sheets P1 and P2 will be described below.

Figure 9:
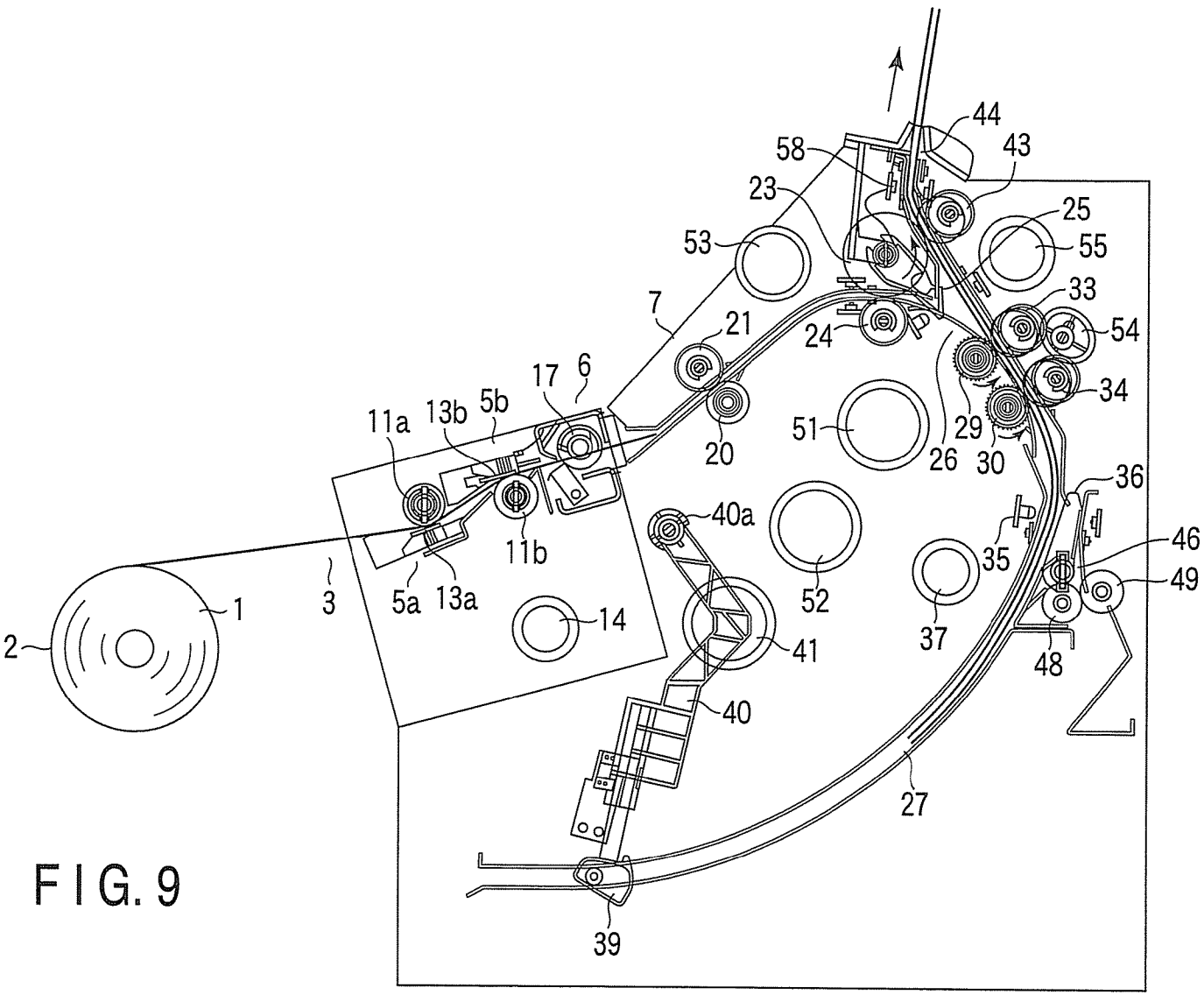
FIG. 9 is a diagram showing a state in which a plurality of paper sheets held in the first and second arc-shaped transfer path shown in FIG. 8 are ejected through an ejecting port.

In this process, first, the third driving motor 53 is operated to rotate the cam 54, so that the third and fourth pinch rollers 33 and 34 are pressed against the third and fourth driving rollers 29 and 30 to produce strong pinching force. After this pressing, the second driving roller 23 is rotated forward and the third and fourth driving rollers 29 and 30 are rotated backward. As a result, the paper sheets P1 and P2 in the first and second arc-shaped transfer paths 26 and 27 are transferred toward the ejecting port 44, as shown in FIG. 9. When the leading ends in the direction of transfer of the paper sheets P1 and P2 are passed through the fifth pinch roller 43 and detected by the ejection detecting sensor 58, the third driving motor 53 is operated and the fifth pinch roller 43 is pressed against the second driving roller 23. As a result of the pressing, the paper sheets P1 and P2 are held and transferred, and the transfer is stopped when the leading ends in the direction of transfer of the paper sheets P1 and P2 are sent out of the ejecting port 44 by a predetermined distance. The paper sheets P1 and P2, the leading ends of which are ejected, are received by the user. At the time of receipt, the third and fourth pinch rollers 33 and 34 are separated and released from the third and fourth driving rollers 29 and 30 while only the fifth pinch roller 43 is in the pinching state, so that the user can easily pull out the paper sheets P1 and P2.

The paper sheets P1 and P2, the leading ends of which are sent out of the ejecting port 44 by the predetermined distance, are detected by the ejection detecting sensor 58. If the detection state continues for a predetermined time or longer, it is assumed that the user did not the paper sheets P1 and P2 out of the ejecting port 44. In this case, the paper sheets P1 and P2 are recovered into the machine.

Figure 10:
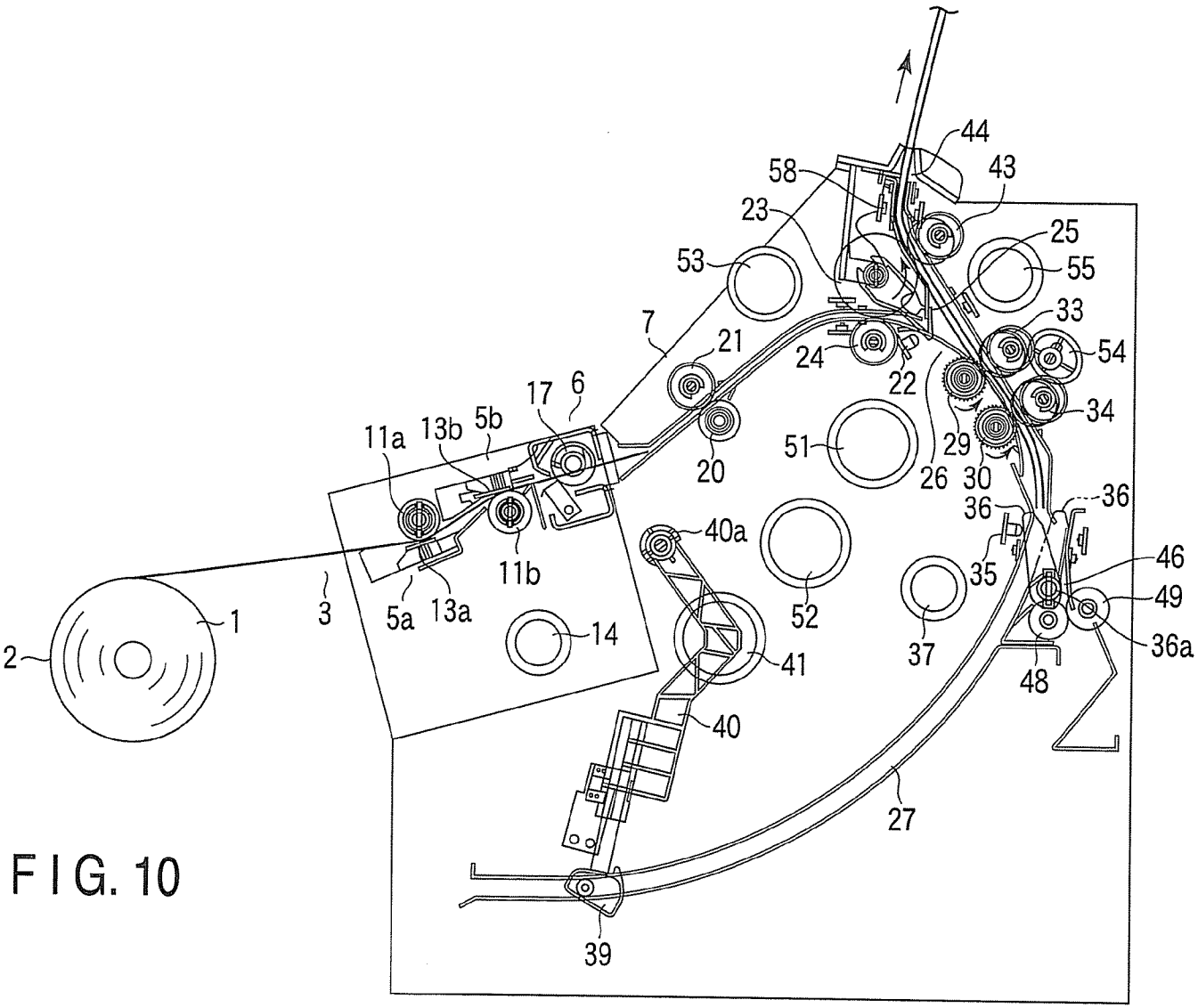
FIG. 10 is a diagram showing a state in which the paper sheets ejected and left in the ejecting port shown in FIG. 9 are recovered toward a collecting storage.
Figure 11:
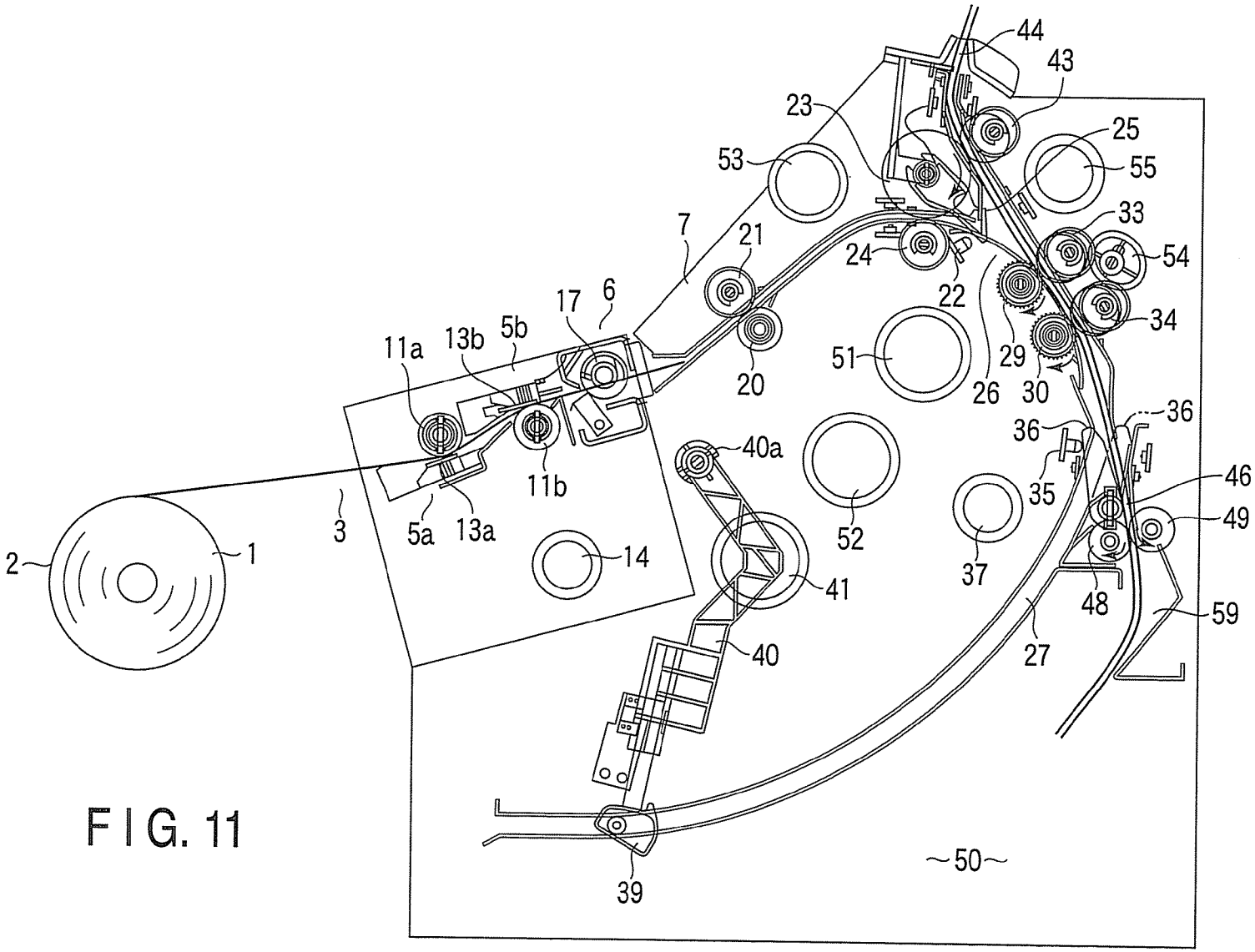
FIG. 11 is a diagram showing a state in which the paper sheets shown in FIG. 10 are sent to the collecting storage.
Figure 12:
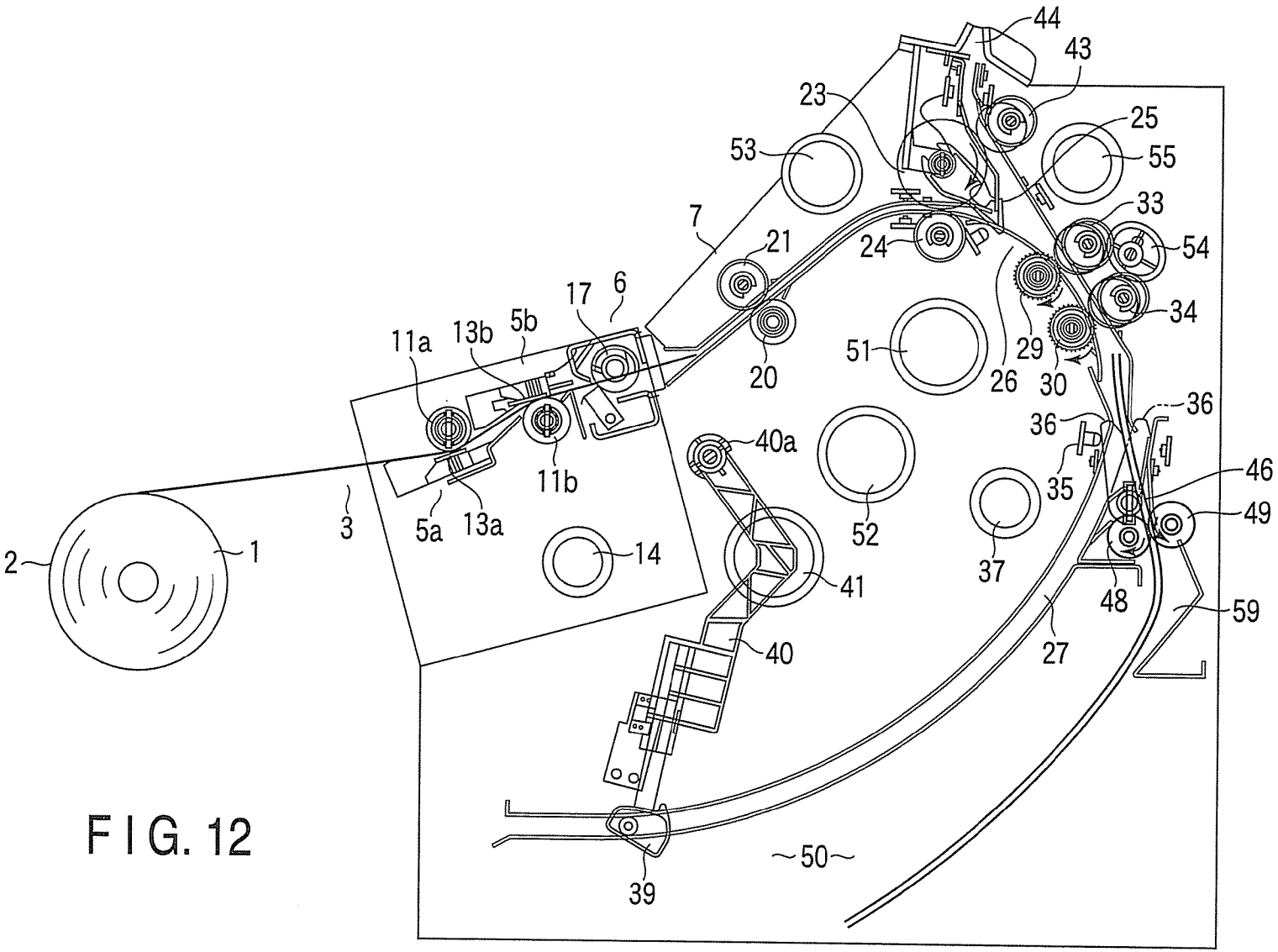
FIG. 12 is a diagram showing a state in which the paper sheets sent as shown in FIG. 11 are further sent and stored in the collecting storage.

When the paper sheets are recovered, the third and fourth pinch rollers 33 and 34 are pressed against the third and fourth driving rollers 29 and 30 to produce strong pinching force. Then, the paper sheets P1 and P2 are transferred further in the ejecting direction by a predetermined distance, as shown in FIG. 10, and stopped when the lower ends in the transfer direction have passed through the flapper 36. Thereafter, the flapper driving motor 37 is operated and the flapper 36 is rotated leftward about the support shaft 36*a* and switches the transfer path to the collecting transfer path 46. From this state, the second driving roller 23 is rotated backward, while the third and fourth driving rollers 29 and 30 and the collecting driving roller 48 are rotated forward. As a result, the paper sheets P1 and P2 are transferred downward to the collecting transfer path 46 and further to the collecting storage 50, as shown in FIG. 12.

According to the embodiment described above, the first and second arc-shaped transfer paths 26 and 27 constitute the curved transfer path 28 and the paper sheets P1 and P2 are transferred through the transfer path 28 and held in the curved state. Therefore, the height of the paper sheet holding section in the vertical direction can be reduced, resulting in the compact printing apparatus.

Further, since the stopper 39 is provided in the second arc-shaped transfer path 27 and moved along the second arc-shaped transfer path 27 in accordance with the length of the paper sheet, paper sheets of various lengths can be held in alignment.

Furthermore, since the collecting storage 50 is provided under the second arc-shaped transfer path 27, the space under the second arc-shaped transfer path 27 is efficiently utilized.

Moreover, the rugged portion 29*a* and 30*a*, having continuous teeth, are formed on one end of the third and fourth driving rollers 29 and 30 along the circumferential direction thereof. Therefore, the paper sheet can be transferred stably, even when the third and fourth pinch rollers 33 and 34 are brought into contact with the third and fourth driving rollers 29 and 30 by weak force or when the paper sheets of different thicknesses are transferred.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A printing apparatus comprising:

a transfer device which continuously transfers paper sheets along a main transfer path;

a printing device which prints information on the paper sheets, which are consecutively transferred along the main transfer path;

a holding section connected to a downstream end of the main transfer path and formed of a curved transfer path, which consecutively transfers the paper sheets led out from the main transfer path in a curved state and holds them in an overlaid state, wherein the curved transfer path comprises a first arc-shaped transfer path connected to a downstream end of the main transfer path and a second arc-shaped transfer path connected to a downstream end of the first arc-shaped transfer path;

a driving roller and a pinch roller, which face each other via the first arc-shaped transfer path and hold and transfer the paper sheets, wherein the driving roller and the pinch roller are separated from each other before passing a leading end of the paper sheet introduced in the first arc-shaped transfer path, and after the passing, hold and transfer the paper sheet to the second arc-shaped transfer path;

wherein the driving roller and the pinch roller serve as a sending device, which collectively sends the paper sheets out of the holding section; and an ejecting section, which ejects the paper sheets collectively sent out by the sending device.

2. The printing apparatus according to claim 1, wherein the driving roller has a rugged portion on a circumferential surface in a peripheral portion thereof, the rugged portion being brought into contact with the paper sheets.

3. The printing apparatus according to claim 1, further comprising a stopper, which is located in the second arc-shaped transfer path, moves along a direction of transfer of the paper sheet in accordance with a length of the paper sheet, and stops the transferred paper sheet upon contact with a leading end of the paper sheet in the direction of transfer.

4. The printing apparatus according to claim 3, wherein the stopper is located in a distal end of a stopper arm which rotates about an axis, the axis of the stopper arm being located between a center of radius of the second arc-shaped transfer path and the second arc-shaped transfer path.

5. The printing apparatus according to claim 1, wherein the driving roller and the pinch roller serve as the sending device, rotate in a direction opposite to that in holding the paper sheets, hold and transfer the paper sheets to send them out to the ejecting section.

6. The printing apparatus according to claim 5, wherein the driving roller and the pinch roller are separated from each other after sending the paper sheets to the ejecting section.

7. The printing apparatus according to claim 6, wherein when the paper sheets ejected in the ejecting section are left for a predetermined period of time, the paper sheets are held and transferred by the driving roller and the pinch roller and recovered from the ejecting section.

8. The printing apparatus according to claim 7, further comprising a collecting storage which stores the recovered paper sheets.

* * * * *